United States Patent [19]

Norman et al.

[11] 4,221,861

[45] Sep. 9, 1980

[54] BACKSIDE ANTISTATIC COATED FILM BEARING A LIGHT SENSITIVE EMULSION

[75] Inventors: Paula R. Norman, Midland; Sally P. Ginter, Sanford, both of Mich.

[73] Assignee: The Dow Chemical Company, Midland, Mich.

[21] Appl. No.: 893,849

[22] Filed: Apr. 6, 1978

[51] Int. Cl.[2] ..... G03C 1/78; G03C 1/96

[52] U.S. Cl. ..... 430/529; 430/527

[58] Field of Search ..... 96/87 R, 87 A, 114.2

[56] References Cited

U.S. PATENT DOCUMENTS

| | | | |
|---|---|---|---|
| 3,442,654 | 5/1969 | Eiseman et al. | 96/114 |
| 3,551,152 | 12/1970 | Mackey et al. | 96/87 A |
| 3,552,972 | 1/1971 | Meyer et al. | 96/87 A |
| 3,769,022 | 10/1973 | Villi et al. | 96/87 A |
| 4,014,854 | 3/1977 | Stevens et al. | 204/159.16 |
| 4,077,991 | 3/1978 | Stevens et al. | 260/18 |
| 4,080,161 | 3/1978 | Stevens et al. | 260/18 EP |

*Primary Examiner*—Jack P. Brammer

*Attorney, Agent, or Firm*—Douglas N. Deline; David H. Fifield

[57] ABSTRACT

An improved process for preparing a film bearing a light sensitive emulsion, backside coated with a topical antistat, comprising:

(a) applying to the backside a photographically inert compound curable by exposure to a free-radical source which compound is a copolymer comprised of ethylene oxide and glycidyl $\alpha,\beta$-unsaturated monocarboxylates and (b) exposing said compound to a free-radical source sufficient to render it durably attached to the backside by curing the unsaturated portions thereof and films prepared by said process.

11 Claims, No Drawings

BACKSIDE ANTISTATIC COATED FILM BEARING A LIGHT SENSITIVE EMULSION

BACKGROUND OF THE INVENTION

The invention relates to photographic films which are coated on one face with an antistatic material to reduce the tendency for the accumulation of electrostatic charge. Electrostatic charges are detrimental to such film in the high speed processing thereof because, when discharge of a built-up electrostatic charge occurs, a spark may result which streaks, fogs or spots the photographic emulsion on the opposite face.

The photographically inert, curable topical antistatic agent employed in the instant invention is described generically in U.S. Pat. No. 4,014,854 and is shown coated and cured on various substrates therein. Related compounds are shown in U.S. Pat. No. 4,077,991. Such compounds are crosslinked and cured through hydroxyl groups by aminoplast resins and the like upon various substrates to render them antistatic in U.S. Pat. No. 4,080,161. Various polyglycols or polyglycidol compounds have been shown as topical antistatics or as thermoplastic melt added antistatics in U.S. Pat. Nos. 3,551,152; 3,988,378; 3,879,346; U.K. Pat. No. 1,045,165 (a glycidyl ether); and various other topical antistats are described in *American Dyestuff Reporter,* Feb. 27, 1967, pages 37–43.

In U.S. Pat. No. 3,442,654, water soluble polyoxyalkylene glycol ethers are employed as anti-fogging agents in photographic film gelatins. U.S. Pat. No. 3,551,152 employs a glycidol adduct of a fatty alcohol initiated polyoxyethylene molecule as an antistat for photographic films. *Chem. Abstracts,* 74:93456u (1971) also describes polyglycidol compounds as additive in a photographic stabilization bath. Some of these teachings indicate that certain glycols interfere with photographic emulsions.

SUMMARY OF THE INVENTION

In a process for preparing a film bearing a light sensitive emulsion on one face thereof, the opposite face of which is treated with a topical antistatic agent to reduce the tendency of said opposite face to accumulate an electrostatic charge, the improvement of:

(a) applying to said opposite face, in an amount sufficient to reduce its surface resistivity, a photographically inert compound represented by the formula:

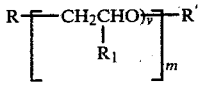

Formula (I)

wherein R is the residue left by removal of m active hydrogen atoms from an initiator compound $R(H)_m$; m is an integer from 1 to 8; R′ is hydrogen or the acyl radical of a carboxylic acid or the carbamoyl radical of a hydrocarbyl isocyanate, said acyl or carbamoyl radical comprising from 1 to about 20 carbon atoms; $R_1$ each occurrence is independently hydrogen, methyl, ethyl, t-butoxymethyl or—$CH_2OX$ wherein X is selected from H and the acyl radical of a carboxylic acid or the carbamoyl radical of a hydrocarbyl isocyanate, said acyl or carbamoyl radical comprising 1 to about 20 carbon atoms; v is a positive number such that the product of v and m is a number whereby the resultant molecular weight of said photographically inert compound is about 1,000 to about 6,000; provided that in about 70 to about 95 percent of its occurrences $R_1$ is hydrogen, in about 5 to about 10 percent of its occurrences $R_1$ is—$CH_2OX$ wherein X is H or Y, which Y is the acyl radical of an $\alpha,\beta$-unsaturated monocarboxylic acid comprising 3 to 10 carbon atoms; in at least one occurrence X is Y and in no more than two occurrences is the carbamoyl radical of a hydrocarbyl isocyanate or the acyl radical of a carboxylic acid other than Y; and (b) exposing the photographically inert compound to a free-radical source sufficient to render it durably attached to said opposite face by curing the unsaturated portions thereof and a film bearing a light sensitive emulsion prepared by this process comprise the instant invention.

The photographically inert compound is prepared as described in U.S. Pat. No. 4,014,854 and is coated on the backside of a film which bears or is to bear a light sensitive emulsion. The compound is then cured by exposure to a suitable free-radical source such as a UV radiation activated initiator, electron beam radiation or other suitable means. The "film" which is so-treated may be made up of or coated with any one of the class of static generating plastics: polycarbonates, polyolefins such as polyethylene and chlorinated polyethylenes, polystyrenes, polyesters, styrene acrylonitriles and cellulose acetates. These materials are normally fabricated in strips commonly thought of as "photographic film" which is normally coated with a negative working light sensitive emulsion for either black and white or color photographic films. These "films" as the term is used herein, also include papers coated with the various plastic materials and a light sensitive emulsion layer which are of the type used for photographic printing from negatives. These also include "instant" developing coated paper films which come directly from a camera bearing a positive working emulsion which is developed in situ.

Due to the tendency of such films to accumulate electrostatic charges which are prone to discharge in processing and handling (and thereby cause spots or shadows on the light sensitive emulsions resulting in photographic reproductions of poor image quality), it is desirable to reduce the tendency of such films to accumulate electrostatic charge. It is, however, necessary that the antistatic agent employed be compatible with the chemicals involved in developing and fixing baths and with the other chemicals employed in the processing of the films and simultaneously avoid fogging or otherwise affecting the unexposed light sensitive emulsion on the film.

It is also desirable that the antistatic agent not be removed by further film processing as in developing and fixing baths. In this fashion, even processed film may maintain its antistatic tendencies and thereby avoid the accumulation of dust which tends to scratch and mar negatives or positive prints upon subsequent handling. It is also detrimental if such an antistatic is leached out by photographic processing baths, thereby affecting the concentrations of such baths or clogging processing equipment.

DETAILED DESCRIPTION OF THE INVENTION

Photographically Inert Compound

In the process and films of the invention, it is preferable to employ as the photographically inert compound represented by Formula (I), a compound wherein $R_1$ is hydrogen in about 70 to about 80 percent of its occurrences, is methyl or ethyl in about 15 to about 25 percent of its occurrences and is—$CH_2OX$ in about 5 to about 10 percent of its occurrences, X being H or Y in all occurrences. It is also preferable to employ as the said compound of Formula (I), a compound wherein X is selected from H and the acyl radical of acrylic, methacrylic or cinnamic acid; more preferably from H and the acyl radical of acrylic acid. In another preferred mode, $R_1$ is H in about 70 to about 95 percent and—$CH_2OX$, wherein X is H or the acyl radical of acrylic acid, in about 5 to about 10 percent of its occurrences. Even more preferably, X is H in about 5 percent and the acyl radical of acrylic acid in about 5 percent of its occurrences, m is 1 to 3 and R' is H or the acyl radical of acrylic acid.

Preferably, the molecular weight of the photographically inert compound of Formula (I) is about 2,000 to about 5,000. Also preferably, R is the residue of bisphenol A, glycerol, water or para-phenylphenol.

For its teachings in the preparation of the compounds of Formula (I), U.S. Pat. No. 4,014,854 is hereby incorporated by reference.

While the compound of Formula (I) may itself suitably be rendered crosslinked and cured on the backside of the film by exposure to any suitable free-radical source, when there are less than 2 acrylate moieties per mole it is preferable to add an additional free-radical curable crosslinking agent. Such agents are pentaerythritol tri- or tetra-acrylate, trimethylol propane tri- or di-acrylate, diacetone acrylamide, or similar reactive diluents commonly employed in the UV radiation-curable coating art. Generally, from about 1 to 20 percent by weight of this additive, based upon the compound of Formula (I), will be suitable to give the desired degree of crosslinking for the durability of the antistatic coating desired.

Processing

While the photographically inert compound of Formula (I) may be applied directly to the backside of a film bearing a light sensitive photographic emulsion, better uniformity in wetting and adhesion is obtained by first corona-treating the surface to which the compound of Formula (I) is to be applied. Ordinarily, it will be more convenient to apply the compound of Formula (I) to the backside of the film prior to the application of the light sensitive emulsion to the foreface of the film since one does then not have to worry about the sensitivity of this film to corona treatment, UV radiation, electron beam radiation or heat.

The compound of Formula (I) can be doctored on the backside of the film by any suitable means commonly employed for such application so a uniform coating is attained. A coating weight of about 0.05 to about 0.25 $g/ft^2$ will normally be a suitable quantity of the compound of Formula (I). The lower molecular weight compounds of Formula (I) are generally viscous liquids which may be applied directly to the backside of the film while the higher molecular weight compounds may suitably be applied from an aqueous or alcohol solution thereof since most are either water soluble or water dispersible. In some instances it may be desirable to add a small amount of a nonionic surfactant to permit their uniform dispersion in an aqueous solution, especially compounds of Formula (I) where in one or two occurrences X is the acyl radical of a carboxylic acid other than Y or is the carbamoyl radical of an isocyanate (e.g., $\phi$NHC(O)O—from reaction of $\phi$NCO with an OH group).

After the compound of Formula (I) has been applied to the backside of the film, it is dried on the film suitably by evaporating solvent at room temperature or by subjecting it to a flow of forced warm air. It is then cured on the film by subjecting it to a source of free-radical radiation.

Free-Radical Source

Curing of the photographically inert antistatic compound of Formula (I) is achieved by exposure of same to a free-radical source, preferably electron beam radiation or an ultraviolet (UV) radiation activated initiator. If not otherwise detrimental to the film, incorporation of a heat sensitive initiator, such as a peroxide, in compound (I) will render the compound curable by exposure to heat.

Representative free-radical sources include such actinic radiation as carbon arc lamps, mercury lamps of the super high, high, or lower pressure types, xenon lamps, ultraviolet fluorescent lamps, lasers, gamma sources and the like, depending on the type and sensitivity of the free-radical initiator(s) and/or sensitizer(s) employed with the compound of Formula (I). When electron beam radiation is employed, it is itself the free-radical source and no initiator or sensitizer is required.

Exemplary photopolymerization initiators include the benzoins such as benzoin, benzoin methyl ether, $\alpha$-methyl benzoin, and the like; anthraquinones such as anthraquinone, chloroanthraquinone, t-butyl-anthraquinone; diketones such as benzyl diketone; phenones such as acetophenone, benzophenone; 2-naphthalene sulfonyl chloride; disulfides such as diphenyl disulfide; dyes such as EOSINE G (C.I. 45380); and the like. Diethoxyacetophenone is preferred because it is water soluble. Those skilled in the art are capable of selecting a suitable initiator and/or sensitizer in the appropriate amounts for the type of actinic radiation employed. Suitably, about 0.1 to 5 percent of the initiators are employed based on the weight of the antistatic compound of Formula (I). The time of exposure to the actinic radiation source can likewise be varied by one skilled in the art to attain the degree of cure desired.

SPECIFIC EMBODIMENTS OF THE INVENTION

In the following examples, photographically inert antistatic compounds of Formula (I) are prepared in the manner described in U.S. Pat. No. 4,014,854 and are applied to and cured on various films commonly employed as carriers for light sensitive emulsions.

The polymeric precursors to the compounds of Formula (I) are prepared by contacting water, bisphenol A, p-phenylphenol, glycerine or dodecanol with a mixture of ethylene oxide (EO) and t-butyl glycidyl ether (TBGE) and, in two examples, additionally containing 1,2-propylene oxide (PO), in the presence of a base catalyst, e.g., sodium metal or potassium hydroxide. Sufficient alkylene oxide is employed, on a molar basis, to obtain a polymer of about the molecular weight desired. Molecular weight of the polymeric product is determined from conventional hydroxyl number analysis. The various polymeric precursors to compound (I) are listed as follows in Table I.

TABLE I

| Precursor | Initiator* | Precursor Compositions Mole Ratios** Alkylene Oxides | Approx. + Mol. Weight |
|---|---|---|---|
| A | BPA | 90 EO/10 TBGE | 5000 |
| B | PPP | 90 EO/10 TBGE | 5000 |
| C | DD | 75 EO/25 TBGE | 3000 |
| D | $H_2O$ | 95 EO/5 TBGE | 6000 |
| E | $H_2O$ | 90 EO/10 TBGE | 5000 |
| F | $H_2O$ | 80 EO/20 TBGE | 4000 |
| G | $H_2O$ | 70 EO/30 TBGE | 5000 |
| H | $H_2O$ | 75 EO/25 TBGE | 1300 |
| I | gly | 70 EO/20PO/10 TBGE | 3000 |
| J | gly | 70 EO/20PO/10 TBGE | 5000 |

*BPA = Bisphenol A
**EO = Ethylene Oxide
PPP = p-Phenyl phenol
TBGE = t-Butyl Glycidyl Ether
DD = Dodecanol
PO = 1,2-Propylene Oxide
gly = Glycerine
+ Calculated from hydroxyl number In a typical esterification reaction, 100 parts (all parts are by weight unless otherwise specified) of Precursor F and 3 parts para-toluenesulfonic acid are heated at about 105° C. for about 1.5 hour to dealkylate the t-butyl groups while a vacuum of about 30 mm Hg is slowly pulled on the reaction mixture to remove the isobutylene generated in the dealkylation. Weight loss indicates that approximately 100 mole percent of the ring-opened TBGE units are dealkylated to form ring-opened glycidol moieties $$(-CH_2\underset{\underset{CH_2OH}{|}}{C}HO-)$$

in the backbone of the dealkylated Precursor F. The reaction mixture is then cooled to about 98° C. About 12 parts acrylic acid containing about 0.1 part $Cu_2O$ inhibitor is added to the reaction mixture. The reaction mixture is then heated at about 100° C. under a vacuum of 150 mm Hg for about 2 hours, then cooled. Titration for unreacted acid in the product indicates that about 39 mole percent of the ring-opened glycidol units are esterified, about 5.1 mole acrylate per mole of the esterified Precursor F. This esterified Precursor F is hereafter referred to as Antistat #1.

In a like manner, the other Precursors are dealkylated and esterified with acrylic acid to various degrees of esterification. In some instances, the Precursor is dealkylated and then reacted with other reactive molecules, e.g., phenyl isocyanate or stearic acid, prior to esterification with acrylic acid. In most instances, the residual p-toluenesulfonic and acrylic acid is permitted to remain in the Antistat product. In a few instances, the residual acids are removed by contacting the Antistat product with a weak base ion exchange resin and in such instances, about 0.01 part phenothiazine is substituted for $Cu_2O$ as inhibitor. Various Antistats are prepared in the previously described fashion and are described below in Table II.

TABLE II

| Antistat No. | Antistat Compositions Precursor | Acrylate (Mole %)* | Residual Acid (meq/g of Antistat) |
|---|---|---|---|
| 1 | A | 24 | 0.56 |
| 2 | A | 53 | 0.81 |
| 3 | A | 55 | 0.86 |
| 4 | A | 56 | 0.07 |
| 5 | A | 57 | 0.79 |
| 6 | A** | 47 | 0.97 |
| 7 | B | 95 | — |
| 8 | C+ | 47 | 0.24 |
| 9 | D | 35 | 0.59 |
| 10 | E | 31 | 0.47 |
| 11 | E | 52 | 0.96 |
| 12 | F | 39 | 0.45 |
| 13 | F | 53 | 1.36 |
| 14 | F | 65 | 1.05 |
| 15 | G | 23 | 1.31 |
| 16 | G | 27 | 1.09 |
| 17 | G | 65 | 1.34 |
| 18 | H | 63 | 1.21 |
| 19 | I | 61 | 0.83 |
| 20 | I | 60 | 0.03 |

*Mole percent of dealkylated ring-opened TBGEunits esterified with acrylic acid.
**1 Mole of primary OH per mole Antistat reactedwith phenyl isocyanate.
+2 Moles of primary OH per mole Antistat reactedwith stearic acid.

The Antistats noted above are tested for their antistatic properties by applying to one side of various films which are pretreated with a Lepel corona treatment machine. The Antistats are applied to the corona-treated films as 30 percent or 50 percent (weight) solutions in methanol containing 3 percent (based on Antistat weight) Vicure 10 benzoin butyl ether or in an 80/20 (volume) water/isobutanol solution containing 3 percent (based on Antistat weight) diethoxyacetophenone. These Antistat solutions are drawn onto the corona-treated film surface with a No. 3 Meyer rod and solvent is allowed to evaporate at room temperature. The coated film is then cured by passing it under a 200 watt/in. high pressure mercury vapor lamp (Preferential Surface Care Unit marketed by Linde Div. of Union Carbide Corporation) at a rate of 100 ft/min in air. The number of passes under the mercury vapor lamp required to obtain a tack-free coating is noted. In some examples, added passes under the lamp are employed to examine the effect on permanence and antistatic properties. When applied from the 30 percent solutions, the coating weight of the Antistat is about 0.10 g/ft$^2$ and from the 50 percent solutions is about 0.15 g/ft$^2$.

To test the antistatic properties of a cured Antistat, six equivalent samples of the same Antistat are preconditioned in a constant humidity chamber for about 16 hours. The Surface Electrical Resistivity (SER) is then determined by applying 100 volts across the surface with a Keithley Model 610B Electrometer, a Model 240 Regulated High Voltage Supply and a Model 6105 Resistivity Adapter. Amperage readings on the 6 samples are averaged and SER is calculated from the formula:

$$SER \text{ in ohms} = \frac{53.4 \times 100 \text{ volts}}{\text{amps measured}}$$

Examples 1–8: On Polyester Film

In the manner described above, Antistats 1, 3, 10–12, 14 16 and 17 are cured on one side of a corona-treated polyester film, both at about 0.10 and 0.15 g/ft$^2$. Their SER's are measured and are reported below in Table III. The coated films are conditioned at 17 percent relative humidity. The SER of uncoated blanks is $>10^{15}$ ohms.

TABLE III

| | SER on Polyester Film | | | |
|---|---|---|---|---|
| | | Passes Under | SER (ohms $\times 10^{-10}$) | |
| Example | Antistat | Lamp | 0.10 g/ft$^2$ | 0.15 g/ft$^2$ |
| 1 | 1 | 20 | 10 | 3 |
| 2 | 3 | 3 | 8 | 2 |
| 3 | 10 | 3 | 4 | 2 |
| 4 | 11 | 2 | 6 | 3 |
| 5 | 12 | 3 | 9 | 4 |
| 6 | 14 | 3 | 43 | 21 |
| 7 | 16 | 6 | 33 | 18 |
| 8 | 17 | 2 | 190 | 98 |

Examples 9–11: On Polyethylene Coated Film

In the manner described above, Antistats 2, 13 and 15 are cured on a polyethylene (PE) coated paper of the type used for photographic prints. The coating weight is both about 0.10 and 0.15 g/ft$^2$. Their SER's are measured and reported below in Table IV. The coated films are conditioned at 18 percent relative humidity. The SER of uncoated blanks is $>10^{15}$ ohms.

TABLE IV

| | SER on Polyethylene Coated Film | | | |
|---|---|---|---|---|
| | | Passes Under | SER (ohms $\times 10^{-10}$) | |
| Example | Antistat | Lamp | 0.10 g/ft$^2$ | 0.15 g/ft$^2$ |
| 9 | 2 | 2 | 4 | 2 |
| 10 | 13 | 2 | 20 | 8 |
| 11 | 15 | 2 | 11 | 5 |

Examples 12–21: Leaching of Antistats

In the following examples, in the manner previously described, Antistats are cured on corona-treated polyester and PE coated paper films at a coating weight of about 0.10 and 0.15 g/ft$^2$. In some instances, Example 17, additional passes under the mercury lamp are employed to test the effect on antistatic properties and leaching. Leaching is evaluated by immersing the cured Antistat-coated films in distilled water at room temperature for 30 minutes, shaking off excess water, allowing to dry at room temperature and conditioning at a given relative humidity (RH), then determining whether a significant rise in SER has occurred. In all cases, the SER rises but not to the level of an uncoated film blank.

The SER's are reported below in Table V.

TABLE V

| | Leaching of Antistats | | | | | | |
|---|---|---|---|---|---|---|---|
| | | | | | | SER (ohms $\times 10^{-10}$) | |
| Example | Antistat | Passes Under Lamp | Type of Film* | Approximate Coating Wt. (g/ft$^2$) | R.H. of Conditioning | Before Bath | After Bath |
| 12 | 5 | 2 | M | 0.10 | 19% | 8 | 270 |
| 13 | 6 | 2 | " | " | " | 11 | 45 |
| 14 | 9 | 4 | " | " | " | 5 | 41 |
| 15 | 18 | 2 | " | " | " | 45 | 1300 |
| 16 | 4 | 2 | PE | " | 17% | 8 | 16 |
| 17 | 4 | 2 + 8** | " | " | " | 11 | 53 |
| 18 | 7 | 2 | " | 0.15 | 20% | 2 | 31 |
| 19 | 8 | 3 | " | " | " | 9 | 360 |
| 20 | 19 | 3 | " | " | " | 2 | 60 |
| 21 | 20 | ' | " | " | " | 21 | — |

*PE = Polyethylene coated paper film
M = Polyester film
**8 Extra passes after tack free

What is claimed is:

1. In a process for preparing a film bearing a light sensitive emulsion on one face thereof, the opposite face of which is treated with a topical antistatic agent to reduce the tendency of said opposite face to accumulate an electrostatic charge, the improvement of:

(a) applying to said opposite face, in an amount sufficient to reduce its surface resistivity, a photographically inert compound represented by the formula:

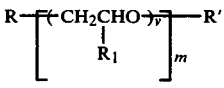

wherein R is the residue left by removal of m active hydrogen atoms from an initiator compound $R(H)_m$; m is an integer from 1 to 8; R' is hydrogen or the acyl radical of a carboxylic acid or the carbamoyl radical of a hydrocarbyl isocyanate comprising from 1 to about 20 carbon atoms; $R_1$ each occurrence is independently H, $CH_3$, $C_2H_5$, t-butoxymethyl or—$CH_2OX$ wherein X is selected from H and the acyl radical of a carboxylic acid or the carbamoyl radical of a hydrocarbyl isocyanate comprising 1 to about 20 carbon atoms; v is a positive number such that the product of v and m is a number whereby the resultant molecular weight of said photographically inert compound is about 1,000 to about 6,000; provided that in about 70 to about 95 percent of its occurrences $R_1$ is hydrogen, in about 5 to about 10 percent of its occurrences $R_1$ is—$CH_2OX$ wherein X is H or Y, which Y is the acyl radical of an $\alpha,\beta$-unsaturated monocarboxylic acid comprising 3 to 10 carbon atoms; and in at least one occurrence X is Y and in no more than 2 occurrences is X the carbamoyl radical of a hydrocarbyl isocyanate or the acyl radical of a carboxylic acid other than Y; and (b) exposing the photographically inert compound to a free-radical source sufficient to render it durably attached to said opposite face by curing the unsaturated portions thereof.

2. The process of claim 1 wherein $R_1$ is hydrogen in about 70 to about 80 percent of its occurrences, $R_1$ is $CH_3$ or $C_2H_5$ in about 15 to about 25 percent of its occurrences, $R_1$ is—$CH_2OX$ in about 5 to about 10 percent of its occurrences and X is H or Y in all occurrences.

3. The process of claim 1 wherein X is selected from H, and the acyl radical of acrylic, methacrylic or cinnamic acid.

4. The process of claim 1 wherein X is selected from H and the acyl radical of acrylic acid.

5. The process of claim 1 wherein $R_1$ is hydrogen in about 70 to about 95 percent, and—$CH_2OX$ wherein X is H or the acyl radical of acrylic acid in about 5 to about 10 percent of its occurrences.

6. The process of claim 5 wherein X is H in about 5 percent and the acyl radical of acrylic acid in about 5 percent of its occurrences, m is 1 to 3 and R′ is H or the acyl radical of acrylic acid.

7. The process of claim 5 wherein the molecular weight of the photographically inert compound is about 2,000 to about 5,000, $R_1$ is hydrogen in about 70 to about 80 percent, $CH_3$ in about 15 to about 25 percent and —$CH_2OX$ wherein X is H or the acyl radical of acrylic acid in about 5 to about 10 percent of its occurrences, m is 1 to 3 and R′ is H or the acyl radical of acrylic acid.

8. The process of claim 7 wherein R is the residue of bisphenol A, glycerol, water or para-phenylphenol.

9. The process of claim 1 or 5 wherein the free-radical source is an ultraviolet radiation activated initiator or is electron beam radiation.

10. A film bearing a light sensitive emulsion prepared by the process of claim 1, 5 or 8.

11. A process of claim 1 wherein the light sensitive emulsion comprises a silver halide.

* * * * *